US005954945A

United States Patent [19]

Cayton et al.

[11] Patent Number: 5,954,945

[45] Date of Patent: Sep. 21, 1999

[54] FLUID HYDROCRACKING CATALYST PRECURSOR AND METHOD

[75] Inventors: Roger H. Cayton, Naperville; Ronald B. Fisher, Geneva; Jeffrey T. Miller, Naperville; John A. Waynick, Warrenville, all of Ill.

[73] Assignee: BP Amoco Corporation, Chicago, Ill.

[21] Appl. No.: 08/827,191

[22] Filed: Mar. 27, 1997

[51] Int. Cl.[6] ..... C10G 47/02

[52] U.S. Cl. ..... 208/108; 208/112; 208/420; 585/752

[58] Field of Search ..... 208/108, 112, 208/420; 585/752

[56] References Cited

U.S. PATENT DOCUMENTS

| | | | |
|---|---|---|---|
| 2,005,192 | 6/1935 | Krauch et al. | 208/419 |
| 2,006,996 | 7/1935 | Krauch | 208/419 |
| 2,119,647 | 6/1938 | Pier et al. | 208/421 |
| 2,127,382 | 8/1938 | Pier et al. | 208/423 |
| 2,159,511 | 5/1939 | Pier et al. | 208/108 |
| 2,402,683 | 6/1946 | Signaigo | 502/220 |
| 3,297,563 | 1/1967 | Doumani | 208/59 |
| 3,657,111 | 4/1972 | Gleim | 208/108 |
| 3,663,431 | 5/1972 | Wagner | 208/143 |
| 4,134,825 | 1/1979 | Bearden, Jr. et al. | 208/108 |
| 4,136,013 | 1/1979 | Moll et al. | 208/10 |
| 4,163,728 | 8/1979 | Cheng et al. | 252/18 |
| 4,172,814 | 10/1979 | Moll et al. | 208/108 |
| 4,178,227 | 12/1979 | Mctrailer et al. | 208/50 |
| 4,192,735 | 3/1980 | Aldridge et al. | 208/112 |
| 4,299,685 | 11/1981 | Khulbe et al. | 208/48 |
| 4,376,037 | 3/1983 | Dahlberg et al. | 208/111 |
| 4,389,301 | 6/1983 | Dahlberg et al. | 208/99 |
| 4,431,520 | 2/1984 | Giuliani et al. | 208/112 |

(List continued on next page.)

FOREIGN PATENT DOCUMENTS

| | | | |
|---|---|---|---|
| 903880 | 4/1986 | Belgium . | |
| 1207265 | 7/1986 | Canada | C10G 45/00 |
| 0267674 | 5/1988 | European Pat. Off. | C10G 9/16 |
| 0396384 | 5/1990 | European Pat. Off. | C10G 47/00 |
| 0429132 | 5/1991 | European Pat. Off. | C10G 49/02 |
| 0549257 | 12/1992 | European Pat. Off. | C10G 47/02 |

OTHER PUBLICATIONS

Excerpt from *Energy Progess* (vol. 1, No. 1–4) entitled "Novel Catalyst and Process to Upgrade Heavy Oils" authored by Roby Bearden and Clyde L. Aldridge of Exxon R&D Laboratories, Baton Rouge, LA pp. 44–48 (Dec. 1981).

Pending U.S. Patent Application No. 08/761,746, filed Dec. 5, 1996 as Miller et al.

*Primary Examiner*—Walter D. Griffin
*Assistant Examiner*—Nadine Preisch
*Attorney, Agent, or Firm*—Robert A. Yesukevich; Frank J. Sroka

[57] ABSTRACT

A method for converting a hydrocarbonaceous feedstock to a lower boiling temperature product is described which comprises suspending metal sulfide particles and oxide particles in a reaction zone including hydrogen and the hydrocarbonaceous feedstock at hydrocracking conditions. The metal sulfide particles and the oxide particles are introduced into the reaction zone through particle precursor fluids which precipitate upon heating to form the particles. The metal sulfide particles contain sulfidable transition metals. The oxide particles contain oxidisable elements such as magnesium, aluminum, silicon, phosphorous, calcium, scandium, titanium, gallium, germanium, zirconium, cerium, and mixtures thereof and are not hydrogenation catalysts under the reactor conditions. The oxide particles resist being chemically reduced by reducing agents in the reaction zone. Surprisingly, the presence of the oxide particles is associated with a significant reduction of coke production in the reaction zone. A hydrogenation catalyst precursor comprising a hydrocarbonaceous feedstock, a sulfide particle precursor fluid, and an oxide particle precursor fluid is also described.

17 Claims, 1 Drawing Sheet

U.S. PATENT DOCUMENTS

| | | | |
|---|---|---|---|
| 4,495,306 | 1/1985 | Budahn et al. | 502/185 |
| 4,564,441 | 1/1986 | Kukes et al. | 208/108 |
| 4,578,179 | 3/1986 | Kukes et al. | 208/110 |
| 4,578,181 | 3/1986 | Derouane et al. | 208/110 |
| 4,579,646 | 4/1986 | Grosboll et al. | 208/108 |
| 4,659,452 | 4/1987 | Howell | 208/89 |
| 4,695,369 | 9/1987 | Garg et al. | 208/112 |
| 4,761,220 | 8/1988 | Beret et al. | 208/59 |
| 4,770,764 | 9/1988 | Ohtake et al. | 208/73 |
| 4,863,887 | 9/1989 | Ohtake et al. | 502/150 |
| 4,954,473 | 9/1990 | Gatsis | 502/171 |
| 4,969,988 | 11/1990 | Jain et al. | 208/108 |
| 5,055,174 | 10/1991 | Howell et al. | 208/112 |
| 5,283,217 | 2/1994 | Ikura et al. | 502/167 |
| 5,412,130 | 5/1995 | Karol | 556/57 |
| 5,446,002 | 8/1995 | Kukes et al. | 502/155 |
| 5,489,375 | 2/1996 | Joseph et al. | 208/108 |

FLUID HYDROCRACKING CATALYST PRECURSOR AND METHOD

BACKGROUND OF THE INVENTION

1. Field of the Invention

The present invention relates to catalysts and processes for treating heavy feedstocks such as petroleum residuum. The invention more particularly relates to catalysts suitable for promoting hydrocracking reactions which convert such feedstocks to products having relatively lower boiling temperatures, to processes for making and using the catalysts, and to processes for using such catalysts.

2. Description of the Prior Art

Maximizing the yield of highly-valued products from crude oil often results in the production of relatively heavy hydrocarbon streams which are difficult to upgrade to lighter products. Typically, these streams are distillation bottoms resulting from the atmospheric or vacuum distillation of a crude oil or a crude oil-derived feedstream. These bottoms fractions are known as petroleum residuum or "resid." Resids typically contain only a relatively small amount of material boiling below about 1000° F. at atmospheric pressure, up to several tens of percent of Ramsbottom carbon, and up to several hundred parts per million of metals such as nickel and vanadium.

Modern refinery economics demand that resids be processed to yield lighter and more valuable hydrocarbons. Typically, resid will be upgraded in a multi-reactor, supported catalyst system such as those described in U.S. Pat. No. 4,940,529 issued to Beaton et al; U.S. Pat. No. 5,013,427 issued to Mosby et al.; U.S. Pat. No. 5,124,025 issued to Kolstad et al.; U.S. Pat. No. 5,124,026 issued to Taylor et al.; and U.S. Pat. No. 5,124,027 issued to Beaton et al., all assigned to the assignee of the present invention, the disclosures of which are hereby incorporated by reference. While supported catalyst systems such as those disclosed in the foregoing patents have proven highly effective in upgrading heavy feedstreams such as resids, refmers continue to investigate other processes for obtaining valuable products from resids.

Another approach for upgrading resid is to hydrocrack resid in the presence of a soluble catalyst which is eventually precipitated to produce a solid catalyst dispersed as, for example, a suspended bed or an ebullating bed. This approach is described, among other places, in U.S. Pat. No. 4,134,825 issued to Bearden, Jr. et al.; U.S. Pat. No. 5,055,174 issued to Howell et al.; U.S. Pat. No. 5,446,002 issued to Kukes et al.; and U.S. Pat. No. 5,489,375 issued to Joseph et al., which are hereby incorporated by reference. Although the soluble catalyst is at least initially soluble in a feedstock or a carrier liquid, the soluble catalyst is generally precipitated to provide a dispersion of fine solids, such as metal disulfide particles, in the reactor.

Other researchers have reported that the presence of additional particulate matter tends to suppress coke production within a resid hydrocracking reaction zone that includes a fine catalytic dispersion of the type which may be precipitated from a soluble catalyst. U.S. Pat. No. 4,178,227 issued to Metrailer et al.; U.S. Pat. No. 4,376,037 issued to Dahlberg et al.; U.S. Pat. Nos. 4,770,764 and 4,863,887 issued to Ohtake et al.; and U.S. Pat. No. 5,320,741 issued to Johnson et al., which are hereby incorporated by reference, describe catalyst systems which contain fine contact particles and a dispersed precipitate from a soluble catalyst.

An improved process for increasing the catalytic conversion of heavy feedstocks is described in U.S. Pat. No. 4,695,369 issued to Garg et al. In the process, heavy oil and gaseous hydrogen in the presence of two metal catalysts are reportedly passed to a reaction zone. One of the metal catalysts is described as a highly effective oil soluble hydrogenation catalyst, such as cobalt, nickel, molybdenum or tungsten. The other of the metals catalysts is described as relatively inexpensive and readily available, such as zinc, iron or copper, and either oil soluble or a fine particulate. The '369 patent states that the use of a combination of a good hydrogenation catalyst and a greater amount of the relatively less expensive catalyst is found to increase the overall conversion and to decrease coke formation.

European patent application number 87307863.8 listing Eaton as inventor describes the use of overbase complexes of metal oxides and carbonates associated with metal salts as antifoulants for oil, gas and petrochemical refinery processes. The antifoulant composition is described as comprising at least one overbase complex of an oxide of a metal selected from the group consisting of Mg, Ca, Ba, Sr and Mn and mixtures thereof, and a metal salt of at least one organic complexing agent. The European application lists the crude unit, the fluid catalytic cracker and the hydrocracker as examples of oil refinery units which require the addition of antifoulant chemicals. The antifoulant composition reportedly undergoes a decomposition upon heating to afford minute particles of metal oxide or metal carbonate having a size no greater than about two microns which are used in an amount of about 5 ppm to about 1000 ppm by weight to inhibit fouling in a fouling area.

U.S. Pat. No. 5,283,217 issued to Ikura et al. describes a micro-emulsion prepared by forming an aqueous solution of a salt of a transition metal and a surfactant, adding the solution to a petroleum pitch or distillate, and mixing vigorously. Upon exposure to severe reducing conditions, the emulsion reportedly forms particles of a hydrogenation catalyst which have an average size of less than about 500 angstroms. The '217 patent states that the emulsion can be admixed with finely powdered clay, alumina, or amorphous or crystalline aluminosilicate so that when precipitation/reduction occurs colloidal clusters of metals deposit upon much larger particles of solid material.

In order to facilitate the cost-efficient upgrading of hydrocarbon feedstocks such as resid, new catalysts and processes are still required which minimize catalyst preparation costs and maximize the effectiveness of soluble catalysts under the aggressive operating conditions typically required to produce substantial quantities of lighter, more valuable products from a heavy hydrocarbon feedstock such as resid. Preferably, the new catalysts are injected as fluids so as to avoid solids handling at the processing facility.

SUMMARY OF THE INVENTION

The invention provides a method for converting a relatively heavy hydrocarbonaceous feedstock to a lighter product through contact with hydrogen and a dispersion of minute particles which comprises metal sulfide particles and oxide particles in a reaction zone. The oxide particles persist under reaction zone conditions and, while not catalytically active by themselves for hydrogenation under the reaction zone conditions, serve to attenuate the production of toluene insoluble coke. The oxide particles, and preferably the metal sulfide particles, are introduced into the reaction zone by means of particle precursor fluids which precipitate upon heating to form the particles of the dispersion. When both the metal sulfide particles and the oxide particles are introduced into the reaction zone through the use of particle precursor fluids, advantages associated with the presence of the dispersion of particles in the reaction zone may be enjoyed without resort to objectionable solids handling operations for preparing and injecting such particles.

It has now been discovered that the presence of certain oxide particles can significantly improve the coke suppression activity of traditional metal sulfide hydroconversion catalysts. The oxide particles, by themselves, exhibit essentially no catalytic activity toward coke suppression. However, when the oxide particles are combined with a metal sulfide hydrocracking catalyst under hydrogenation reaction conditions, the resulting combination catalyst exhibits improved coke suppression activity as compared to traditional catalysts. The oxide particles are introduced by means of an oxide particle precursor fluid.

The oxide particle precursor fluid can be water soluble, in which case the oxide particle precursor fluid is preferably dispersed in the hydrocarbonaceous feedstock by agitating so as to produce an emulsion. Alternatively, the oxide particle precursor fluid includes two functionalities: a.) an organic functionality which provides solubility in the hydrocarbonaceous feedstock phase, and b.) an inorganic functionality which produces, upon precipitation, relatively small and dispersed particles which can serve as a surface for deposition of the soluble catalyst and any coke which is formed.

The use of the oxide particles with a metal sulfide hydroconversion catalyst has several potential advantages, particularly when the oxide and the metal sulfide are introduced into the hydrocarbon feed as hydrocarbon soluble precursors. The total cost of the combination catalyst may be less, as compared to that of traditional catalysts of equal activity, because the oxide particles are less expensive than traditional hydrocarbon soluble catalysts, and because less of the relatively expensive metal sulfide catalyst precursor is required to achieve the same activity. Also, because the soluble combination catalyst is relatively more active per unit weight than many traditional catalysts, less of the combination catalyst need be introduced into the reaction zone. Additionally, the use of a soluble additive in place of a finely ground solid, such as carbon black, avoids cumbersome solids handling operations which are otherwise necessary to prepare and inject the finely ground solid.

In one aspect, the invention is a method which comprises suspending metal sulfide particles and oxide particles as a dispersion in a reaction zone including hydrogen and a hydrocarbonaceous feedstock. The reaction zone is maintained under hydrogenation reaction conditions effective to convert the feedstock to a product having a lower temperature boiling point, as compared to the boiling point of the feedstock. The metal sulfide particles have an effective suspended particle size of about 0.001 to about 50 microns, and are composed essentially of a transition metal sulfide which persists under the reaction conditions.

An oxide particle precursor fluid is blended with the feedstock to produce a blend, and highly dispersed oxide particles are precipitated by heating the blend. The oxide particles have an effective suspended particle size of about 0.001 to about 50 microns, and are composed essentially of an oxide which persists under the reaction conditions. The oxide is an oxide of an oxidisable element selected from Group IIA, IIIB, IVB, IIIA, IVA, or VA, or a mixture thereof, of the Periodic Table of the Elements. The method also comprises separating the product from the metal sulfide particles and the oxide particles, and recovering the product.

In another aspect, the invention is a method which comprises precipitating a sulfide particle precursor fluid which includes a hydrocarbon soluble metal compound containing a sulfidable metal selected from the group consisting of molybdenum, cobalt, nickel, iron, vanadium, tungsten and mixtures thereof. The precipitation gives rise to metal sulfide particles composed essentially of a metal sulfide of the sulfidable metal. An oxide particle precursor fluid is also precipitated which includes a hydrocarbon soluble metal compound containing an oxidisable element selected from the group consisting of magnesium, aluminum, silicon, phosphorous, calcium, scandium, titanium, gallium, germanium, zirconium, cerium, and mixtures thereof. Precipitation of the oxide particle precursor fluid leads to the formation of oxide particles composed essentially of an oxide of the oxidisable element.

The metal sulfide particles and the oxide particles are suspended in a reaction zone which includes hydrogen and a hydrocarbonaceous feedstock so as to create a dispersion under hydrogenation reaction conditions effective to convert the feedstock to a product having a lower temperature boiling point, as compared to the boiling point of the feedstock. The lower boiling point product is separated from the metal sulfide particles and the oxide particles, and the lower boiling point product is recovered.

In yet another aspect, the invention is a highly dispersed hydrogenation catalyst precursor. The catalyst precursor comprises a hydrocarbonaceous feedstock including at least about five volume percent of a boiling range fraction having a weight average boiling point at atmospheric pressure which is equal to or greater than 1000° F. The catalyst precursor also comprises a sulfide particle precursor fluid which includes a transition metal compound containing a sulfidable metal selected from the group consisting of molybdenum, cobalt, nickel, iron, vanadium, tungsten and mixtures thereof. The sulfide particle precursor fluid is susceptible upon heating to precipitation which produces metal sulfide particles composed essentially of a metal sulfide of the sulfidable metal having an effective suspended particle size of about 0.001 to 50 microns.

The catalyst precursor additionally comprises an oxide particle precursor fluid which includes a compound containing an oxidisable element selected from the group consisting of magnesium, aluminum, silicon, phosphorous, calcium, scandium, titanium, gallium, germanium, zirconium, cerium, and mixtures thereof. The oxide particle precursor fluid is susceptible upon heating to precipitation which produces oxide particles composed essentially of an oxide of the oxidisable element having an effective suspended particle size of about 0.001 to 50 microns. Preferably, the sulfide particle precursor fluid and the oxide particle precursor fluid are hydrocarbon soluble and present in the feedstock as solutes. Alternatively, at least one of the sulfide particle precursor fluid and the oxide particle precursor fluid is water soluble and the water soluble fluid is present as the solute in an aqueous solution emulsified with the feedstock.

DESCRIPTION OF THE DRAWINGS

The FIGURE is a graph which depicts toluene-insoluble coke production in a reaction zone under hydrocarbon hydrogenation conditions as a function of the type and concentration of an oxidisable element. The oxidisable element is present as a component of oxide particles dispersed in the reaction zone. Also included in the reaction zone are dispersed metal sulfide particles, hydrogen, and a relatively heavy hydrocarbon charge.

DETAILED DESCRIPTION OF PREFERRED ASPECTS OF THE INVENTION

Figure 1:
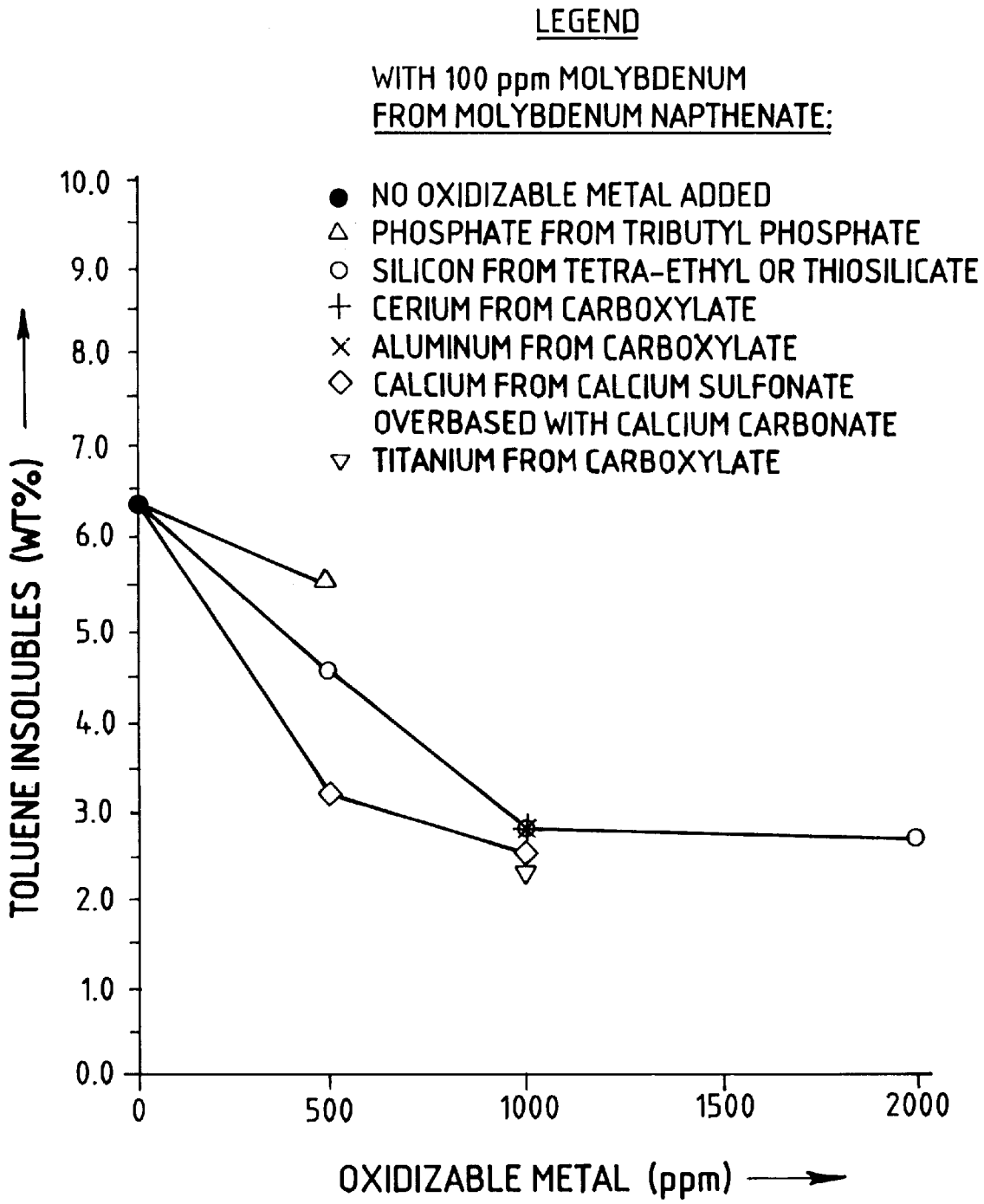

In a preferred aspect, the invention is a method for converting hydrocarbonaceous feedstock to a product having a boiling point of lower temperature, as compared to the boiling point of the feedstock. The feedstock may be, for example, petroleum crude oil, shale oil, tar sand oil, a coal-derived liquid, atmospheric or vacuum distillation resid, hydroprocessing or catalytic cracking resid, or the product of solvent extracting a petroleum or a petroleum derivative.

It is preferred that the feedstock contains a significant proportion, and even more preferred that the feedstock contains at least about five volume percent based on the total volume of the feedstock, of a boiling range fraction having a weight average boiling point at atmospheric pressure which is equal to or greater than 1000° F., as measured by American Society for Testing and Materials procedure ASTM D-86. Alternatively, because some feedstocks or boiling range fractions thermally decompose at temperatures cooler than their atmospheric boiling points, it is contemplated that the atmospheric boiling temperature may be determined by tests conducted at conditions other than atmospheric and corrected to atmospheric boiling temperature by well-known procedures. For example, the atmospheric boiling temperature may be inferred from vacuum distillation data employing American Society for Testing and Materials procedure ASTM D-116, or by a chromatographic technique generally known to the petroleum refining industry as simulated distillation.

The method includes suspending metal sulfide particles and oxide particles as a dispersion in a reaction zone. The dispersion may be, for example, a colloid, a suspension, an ebullating bed of particles, or a fluidized bed of particles. The particles may travel through the reaction zone one or more times, or the particles may be retained in the reaction zone. The particles have a suspended effective particle size of about 0.001 to about 50 microns, preferably about 0.01 to about 10 microns, and more preferably about 0.01 to about 2 microns, with less than about 1 micron being ideal.

Attention is drawn to the fact that relatively smaller particles generally perform more effectively in the present invention, as compared to larger particles. It is contemplated that each of the metal sulfide particles and each of the oxide particles of the present invention may consist of only a few associated molecules, respectively, having a suspended effective particle size of about 0.001 microns. A micron, also termed a micrometer, is a unit of length equal to one millionth of a meter.

Herein, the term effective particle size relates to the dimensions of solids as they are observed while suspended in a given medium. The effective particle size of the slurry may be greater than the initial size of the particles which were blended to produce the slurry. For example, if carbon particles are poorly dispersed or tend to agglomerate in an oil, their effective particle size in a slurry may be greater than their initial particle size.

For the present purposes, the Hegman Grind Gauge manufactured by Paul N. Gardner is the definitive measuring device for determining the effective particle size of slurries in the range of 0.1 to 25 microns. The Zeiss Inverted Microscope at 400× with a dark field condenser is designated the standard for slurries having larger particles and for slurries having smaller particles than can be accommodated by the Hegman Grind Gauge. The effective particle size of slurries having particles which are too small to be measured by the Zeiss Inverted Microscope are determined by electron microscope.

The metal sulfide particles are composed essentially of a sulfur-containing compound including a sulfidable transition metal. Preferably, the sulfidable metal is selected from the group consisting of molybdenum, cobalt, nickel, iron, vanadium, tungsten, and mixtures thereof. Of these, molybdenum is especially preferred. The total weight of the sulfidable metal supported on the impregnated particles in the reaction zone is preferably about 1 to about 500 parts per million; more preferably, about 1 to about 300 parts per million; and most preferably, about 1 to about 200 parts per million by weight, based on the sum of the weight of the feedstock and the weight of the lower boiling point product in the reaction zone. A sulfide is defined as a compound of sulfur analogous to an oxide or an ether with sulfur in place of oxygen.

The metal sulfide particles are preferably introduced by way of a sulfide particle precursor fluid which is blended with the feedstock or injected into the reaction zone. The sulfide particle precursor fluid can be water soluble, in which case the sulfide particle precursor fluid is preferably dissolved in an aqueous solvent, and the resulting aqueous solution is emulsified in the hydrocarbonaceous feedstock. Alternatively, sulfide particle precursor fluid can be soluble in the feedstock, in which case the sulfide particle precursor fluid is dispersed as a solute in the feedstock. The sulfide particle precursor fluid may be, for example, ammonium heptamolybdate, an alkali metal heptamolybdate, cobalt nitrate, nickel nitrate, ferrous sulfate, or sodium tungstate. Molybdenum naphthenate and a proprietary composition of molybdenum, which is commercially available under the tradename Molyvan-L from R. T. Vanderbilt of Norwalk, Conn., are especially preferred as sulfide particle precursor fluids.

Upon heating in the presence of sulfur, hydrogen sulfide, or a sulfur-containing hydrocarbon compound, the sulfide particle precursor fluid precipitates to form metal sulfide particles. While it should be apparent that some source of sulfur is necessary to form the metal sulfide particles, it is found in practice that some sulfide particle precursor fluids incorporate sufficient sulfur so that no additional sulfur source is required. For example, the above-mentioned proprietary composition Molyvan-L is capable of forming metal sulfide particles in the absence of an additional sulfur source.

The site of sulfide formation may be in the reaction zone or, alternatively, in an upstream sulfiding zone or at a remote location. Regardless of their method and site of formation, the metal sulfide particles exhibit catalytic activity under hydrogenation conditions which tends to promote the hydrogenation of hydrocarbons and to suppress the formation of toluene soluble coke.

The oxide particles are composed essentially of an oxygen-containing compound including an oxidisable element selected from the Group IIA, IIIB, IVB, IIIA, IVA, or VA, or a mixture thereof, of the Periodic Table of the Elements as depicted on the inside front cover of PERRY'S CHEMICAL ENGINEER'S HANDBOOK (Sixth Edition). For the present purposes, the Lanthanide series of elements are considered to be members of Group IIIB. Preferably, the oxidisable element is selected from the group consisting of magnesium, aluminum, silicon, phosphorous, calcium, scandium, titanium, gallium, germanium, zirconium, cerium, and mixtures thereof; more preferably, the group consisting of phosphate, silicon, cerium, aluminum, calcium, and mixtures thereof. Of these, silicon and aluminum are especially preferred. An oxide is defined as a compound of oxygen with an element or a radical.

Although lead is a member of Group IVA of the Periodic Table, lead is not recommended for use as the oxidisable element of the present invention. Lead is known to poison the catalytic hydrogenation activity of several transition metals, including molybdenum. Therefore, it is expected that any beneficial effects that might be gained by utilizing lead in the present invention would be diminished or outweighed by lead's tendency to suppress the activity of the metal sulfide particles.

The total weight of the oxidisable element supported on the impregnated particles in the reaction zone is preferably about 1 to about 5000 parts per million; more preferably, about 1 to about 2000 parts per million; and most preferably, about 1 to about 1000 parts per million by weight, based on the sum of the weight of the feedstock and the weight of the lower boiling point product in the reaction zone.

The oxide particles are preferably introduced by means of an oxide particle precursor fluid which is blended with the feedstock or injected into the reaction zone. It is preferred that the oxide particle precursor fluid is soluble in the feedstock because, among other things, it is believed that the precipitation of a well-mixed solute produces relatively fine and well dispersed oxide particles. Alternatively, the oxide particle precursor fluid can be water soluble, in which case it is preferred to introduce the oxide particle precursor fluid as an emulsion of aqueous droplets dispersed in the feedstock.

Preferably, the oxide particle precursor fluid is a hydrocarbon soluble compound which contains an oxidisable element selected from Group IIA, IIIB, IVB, IIIA, IVA, or VA, or a mixture thereof, of the Periodic Table. More preferably, the oxide particle precursor fluid contains an oxidisable element selected from the group consisting of magnesium, aluminum, silicon, phosphorous, calcium, scandium, titanium, gallium, germanium, zirconium, cerium, and mixtures thereof; most preferably, the group consisting of phosphate, silicon, cerium, aluminum, calcium, and mixtures thereof. Calcium sulfonate, calcium carbonate, aluminum carboxylate, cerium carboxylate, tributyl phosphate, and tetraethylorthosilicate are especially preferred as the oxide particle precursor fluid.

Upon heating in the presence of oxygen, water, or an oxygen-containing hydrocarbon compound, the oxide particle precursor fluid precipitates to form the oxide particles. The precipitation is complete when the oxide particle precursor fluid has been heated to about 500; more preferably, about 600; and most preferably, about 800° F. While it should be apparent that some source of oxygen is necessary to form the oxide particles, it is found in practice that some oxide particle precursor fluids incorporate sufficient oxygen so that no additional oxygen source is required. For example, aluminum carboxylate and tributyl phosphate and are each capable of forming oxide particles in the absence of an additional oxygen source.

The site of oxide formation may be in the reaction zone or, alternatively, in an upstream oxidizing zone. Precipitating the oxide particles directly into the feedstock from a well dispersed solution or emulsion produces relatively finer and more effective particles than, for example, milling or grinding solids and injecting them into the feedstock. The oxide particles of the present invention enhance the catalytic activity of the metal sulfide particles for hydrogenation of hydrocarbons and tend to suppress the formation of toluene soluble coke. Significantly, the oxide particles persist under hydrogenation conditions, but exhibit essentially no catalytic activity to promote hydrogenation under such conditions.

For the present purposes, a compound is said to persist if it successfully resists chemical change. For example, the oxide particles of the present invention are said to persist in a reaction zone under conditions effective to hydrogenate hydrocarbons because the oxide particles retain their oxygen component by resisting hydrogenation and other reducing reactions under such conditions. Accordingly, detection of an oxygen component in oxide particles which have been exposed to reaction conditions effective to hydrogenate hydrocarbons is strong evidence that the oxide particles persist under the conditions.

The dispersion is a polyphasic mixture, such as a slurry, a suspension, a colloid, a fluidized bed, or an ebullating bed, which includes at least a solid phase and a liquid phase, and preferably contains a gas as well. The gas phase, if present, may be introduced into the reaction zone, as in the case of added hydrogen, or may be produced in the reaction zone by a chemical or a physical reaction. Preferably, the total weight of the metal sulfide particles and the metal sulfide particles dispersed in the reaction zone is about 10 to about 5500 parts per million; more preferably, about 10 to about 2500 parts per million; and most preferably, about 10 to about 1100 parts per million based on the sum of the weight of the feedstock and the weight of the lower boiling point product in the reaction zone. Practitioners will appreciate that the weight of the feedstock in the reaction zone tends to decrease, and the weight of the product in the reaction zone tends to increase, as the feedstock is converted to the product. Calculating the weight fraction of the particles based on the sum of the weights of the feed and the product is intended to increase the reproducibility of the weight fraction determination as compared to, for example, calculating the weight fraction based on the weight of the feed alone.

The reaction zone additionally includes hydrogen and the hydrocarbonaceous feedstock. The reaction zone is maintained at hydrogenation reaction conditions which are effective to convert the feedstock to a product having a boiling point of lower temperature, as compared to the boiling point of the feedstock. The product may be, for example, propane, butane, a gasoline, a gas oil, or a distillate such as kerosene.

Preferably, the effective reaction zone conditions include a temperature of about 750 to about 900° F., more preferably about 780 to about 840° F. Preferably, the effective conditions include a hydrogen partial pressure of about 1000 to about 3500 pounds per square inch absolute, more preferably about 1500 to about 3000 pounds per square inch absolute. Typical residence time in the reaction zone is in the range of about 0.1 to about 20 hours.

For the present purposes, hydrogenation is defined as an addition or substitution reaction in which hydrogen is consumed, including but not limited to hydrocracking. Hydrocracking is defined as a hydrogenation reaction which utilizes hydrogen as a reagent and chemically converts a hydrocarbonaceous feedstock to a relatively lighter hydrocarbonaceous product. The presence of a traditional hydrogenation catalyst, such as a noble metal or a transition metal sulfide, tends to promote the conversion of the feedstock to a lower boiling product and suppress coke formation. However, hydrogenation is known to proceed in the absence of any catalyst when well-known conditions of temperature, hydrogen partial pressure and residence time are maintained in the reaction zone. The role of the catalyst is normally to increase hydrogenation conversion or selectivity.

The oxide particles of the present invention are not regarded by practitioners as hydrogenation catalysts. Indeed, preferred oxide particles exhibit essentially no catalytic activity for promoting hydrocarbon hydrogenation reactions in the absence of a conventional hydrogenation catalyst, such as metal sulfide particles. However, when oxide particles and metal sulfide particles are present as a dispersion in a reaction zone under the effective conditions described above, the dispersion acts as a combination catalyst to promote the conversion and the selectivity of a hydrogenation reaction for converting a hydrocarbonaceous feedstock to a relatively lower boiling product.

While not wishing to be bound by theory, the inventors hypothesize that the surprising synergy provided by the catalyst of the present invention is due to improved contact between the hydrocarbon bulk phase and the oxide particles in the reaction zone. It is believed that oxide particles tend to accumulate coke precursors, which may be suppressed or destroyed in the presence of catalytically active molybdenum. The inventors contemplate that providing suitably small and well-dispersed oxide particles in a hydrogenation reaction zone containing metal sulfide particles tends to accelerate the accumulation of the coke precursors in a manner which inhibits conversion of the coke precursors to toluene insoluble coke and promotes hydrogenation of the coke precursors.

When the hydrogenation reaction has proceeded to a desirable degree of conversion, the product is separated from the oxide particles and the metal sulfide particles. The separation is conveniently accomplished by providing a region of relatively reduced bulk phase flow velocity and permitting the particles to settle under the influence of gravity. Alternatively, or additionally, the particles can be separated by means of decantation, centrifugation, filtration, flotation, electrophoresis, magnetic attraction, vaporization, or the like.

The product is recovered by purification which removes, for example, unreacted feedstock and unwanted byproducts. Recovery of the product is conveniently accomplished by distillation, although such recovery techniques as dewaxing, solvent deasphalting or demetallation, hydrogen sulfide stripping or scrubbing, and fractional crystallization are contemplated. The product may be passed to another reaction zone or another processing unit for further treating or upgrading.

In another preferred aspect, the invention is a method for converting a hydrocarbonaceous feedstock to a lower boiling product, which comprises precipitating a sulfide particle precursor fluid to produce metal sulfide particles composed essentially of a metal sulfide of the sulfidable metal. The sulfide particle precursor fluid includes a sulfidable transition metal which exhibits activity as a hydrogenation catalyst. Preferably, the sulfidable metal is selected from the group consisting of molybdenum, cobalt, nickel, iron, vanadium, tungsten and mixtures thereof.

Preferably, the sulfide particle precursor fluid is soluble in the hydrocarbonaceous feedstock. Examples of preferred hydrocarbon soluble sulfide particle precursor fluids include carboxylates, pentanedioates, carbamates, alkoxides, oxometallates, phosphates, thiocarboxylates, dithiocarbamates, thiolates, and thiometallates of a metal selected from the group consisting of molybdenum, cobalt, tungsten, iron, nickel, vanadium, and mixtures thereof. Molybdenum carboxylates are especially preferred as the sulfide particle precursor fluid.

The method also comprises precipitating an oxide particle precursor fluid to produce oxide particles composed essentially of a oxide of the oxidisable element. The oxide particle precursor fluid includes a metal compound containing an oxidisable element selected from Group IIA, IIIB, IVB, IIIA, IVA, or VA or a mixture thereof of the Periodic Table. Preferably, the oxidisable element is selected from the group consisting of magnesium, aluminum, silicon, phosphorous, calcium, scandium, titanium, gallium, germanium, zirconium, cerium, and mixtures thereof.

Especially preferred oxide particle precursor fluids include calcium sulfonate, calcium carbonate, aluminum carboxylate, cerium carboxylate, tributyl phosphate, and tetraethylorthosilicate. Non-limiting examples of suitable carboxylates include ethanoate, propanoate, hexanoate, naphthenate, and acetate.

In yet another preferred aspect, the invention is a highly dispersed hydrogenation catalyst precursor which comprises a hydrocarbonaceous feedstock including at least about five volume percent of a boiling range fraction having a weight average boiling point at atmospheric pressure which is equal to or greater than 1000° F. The precursor also comprises a sulfide particle precursor fluid which includes a transition metal compound containing a sulfidable metal selected from the group consisting of molybdenum, cobalt, nickel, iron, vanadium, tungsten and mixtures thereof, wherein the sulfide particle precursor fluid is susceptible upon heating to precipitation which produces metal sulfide particles composed essentially of a metal sulfide of the sulfidable metal having an effective suspended particle size of about 0.001 to 50 microns. The precursor additionally comprises an oxide particle precursor fluid which includes a compound containing an oxidisable element selected from the group consisting of magnesium, aluminum, silicon, phosphorous, calcium, scandium, titanium, gallium, germanium, zirconium, cerium, and mixtures thereof, wherein the oxide particle precursor fluid is susceptible upon heating to precipitation which produces oxide particles composed essentially of an oxide of the oxidisable element having an effective suspended particle size of about 0.001 to 50 microns.

The following Examples are presented in order to better communicate the invention.

Catalyst Testing Procedure:

Catalyst evaluation is conducted in a stirred, pressurizable constant-volume reactor utilizing the following performance testing procedure. Petroleum residuum from a vacuum distillation process and decanted oil from a fluidized bed catalytic cracking process are blended by weight in a proportion of 90:10 in order to produce a blended charge. Approximately 40 grams of the blended charge is combined with enough of a sulfide particle precursor fluid to provide from 0 to 100 ppm by weight of molybdenum metal and a sufficient amount of an oxide particle precursor fluid to provide 0 to 2000 parts per million by weight of an oxidisable element, as desired. Properties of the blended charge are presented below in Table I.

The reactor is sealed, purged with hydrogen gas, and pressurized with hydrogen to a pressure of about 1300 about 1400 pounds per square inch gauge. The reactor is heated to a temperature of about 250 to about 400° F., and is held at this temperature while the catalyst is mixed into the feed for 15 minutes. Heating then continues to 825° F. over approximately 10 minutes. Hydrogen sulfide and other reaction products accumulate in the reactor. Reactor pressure peaks at a pressure of about 2000 to about 2600 pounds per square inch gauge and then decreases as hydrogen is consumed by a cracking reaction. Hydrogen additions are made as necessary to keep the pressure over 1900 pounds per inch while at hydrocracking temperatures. The reactor is held at 825° F. for 3 hours, during which time about 90% by weight or more of the feed having an atmospheric boiling point above 1000° F. is converted to products having an atmospheric boiling point below 1000° F. The reactor is cooled from 825° F. to a temperature below cracking temperatures within a period of about five minutes and, thereafter, is cooled to room temperature.

At room temperature, the contents of the reactor are washed with toluene to a 1 liter beaker, the volume in that beaker is brought up to approximately 400 milliliters with toluene, and the mixture is filtered through a dried and tarred extraction thimble. The thimble is extracted for 24 hours with fresh toluene, dried, and weighed. The weight of the thimble less the tare weight and the weight of the catalyst is taken to be the weight of toluene insolubles (TI) formed during the reaction. The weight of toluene insolubles (TI) is reported as a percentage of the resid feed weight.

TABLE I

| Feed Resid Properties | |
|---|---|
| asphaltene (heptane insolubles) | 24 wt. % |
| carbon | 83.7 wt. % |
| hydrogen | 9.5 wt. % |
| sulfur | 5.6 wt. % |
| nitrogen | 0.5 wt. % |
| oxygen | 0.5 wt. % |
| fraction boiling above 1000° F. | 77% |
| aromatic carbon | 35% |
| nickel | 100 ppm |
| vanadium | 500 ppm |
| iron | 20 ppm |
| Ramsbottom carbon | 22% |
| molecular weight (VPO) | 1000 |

Catalyst Preparation

EXAMPLE 1

As a basis for comparison, 40 grams of the blended charge described in Table I above was combined with a quantity of molybdenum naphthenate which contained an amount of molybdenum corresponding to 100 ppm by weight based on the weight of the blended charge. No particles or oxide particle precursors were introduced into the combination. The combination was tested substantially as described above in the Catalyst Testing Procedure, and the toluene-insolubles yield was determined to be 6.30 percent by weight, based on the weight of the blended charge.

EXAMPLE 2

In order to demonstrate the surprising effectiveness of the invention, a resid hydrocracking catalyst was prepared and performance tested, utilizing the Catalyst Testing Procedure described above. More specifically, 40 grams of the blended charge were combined with a quantity of molybdenum naphthenate which contained an amount of molybdenum corresponding to 100 ppm by weight based on the weight of the blended charge. Also, a quantity of tributyl phosphate which contained an amount of phosphate corresponding to 500 ppm by weight was added to the blended charge. The resulting combination was tested substantially as described above in the Catalyst Testing Procedure, and the toluene-insolubles yield was determined to be 5.50 percent by weight, based on the weight of the blended charge.

EXAMPLES 3, 4, and 5

Three additional catalysts of the invention were prepared and tested substantially as described in Example 2 above, except that instead of tributyl phosphate various amounts of tetra-ethyl orthosilicate were added to provide an additional 500 ppm, 1000 ppm, and 1500 ppm by weight of phosphorous in the blended charge, respectively. As in Example 2, a quantity of molybdenum naphthenate which contained an amount of molybdenum corresponding to 100 ppm by weight based on the weight of the blended charge was combined with the blended charge. Toluene-insolubles formation for the combinations were reported as 4.50, 2.80, and 2.70 weight percent, respectively.

EXAMPLE 6

A catalyst of the invention was prepared and tested substantially as described in Example 2 above, except that instead of tributyl phosphate an appropriate amount of cerium carboxylate was added to provide an additional 1000 ppm by weight of cerium in the blended charge resid feed. Toluene-insolubles formation for the combination was reported as 2.80 weight percent.

EXAMPLE 7

A catalyst of the invention was prepared and tested substantially as described in Example 2 above, except that instead of tributyl phosphate an appropriate amount of aluminum carboxylate was added to provide an additional 1000 ppm by weight of aluminum in the blended charge resid feed. Toluene-insolubles formation for the combination containing added aluminum was reported as 2.80 weight percent.

EXAMPLES 8 and 9

Two more catalysts of the invention were prepared and tested substantially as described in Example 2 above, except that instead of tributyl phosphate various amounts of calcium sulfonate overbased with calcium carbonate were added to provide an additional 500 ppm and 1000 ppm by weight of calcium in the blended charge, respectively. As in Example 2, a quantity of molybdenum naphthenate which contained an amount of molybdenum corresponding to 100 ppm by weight based on the weight of the blended charge was combined with the blended charge. Toluene-insolubles formation for the combinations were reported as 3.20 and 2.50 weight percent, respectively.

EXAMPLE 10

Another catalyst of the invention was prepared and tested substantially as described in Example 2 above, except that instead of tributyl phosphate an appropriate amount of titanium carboxylate was added to provide 1000 ppm by of titanium in the blended charge. As in Example 2, a quantity of molybdenum naphthenate which contained an amount of molybdenum corresponding to 100 ppm by weight based on the weight of the blended charge was combined with the blended charge. Toluene-insolubles formation for the combinations was reported as 2.4 weight percent.

Results of Examples 1 through 10 are depicted graphically in the FIGURE. In each trial, the charge blend contained 100 ppm by weight of molybdenum which was added in the form of molybdenum naphthenate. The FIGURE is a graph showing the amount of toluene insolubles produced as functions of the concentration of various oxidisable elements added to the charge blend. The results of each of the Examples 2 through 10, which relate to the present invention, are superior to the control result of Example 1, which is signified by a dark-colored circular symbol located on the ordinate. It can be seen that addition of titanium carboxylate gave rise to the least amount of toluene insolubles, among those oxidisable elements tested. However, toluene insolubles production for the range of about 1 ppm to about 100 ppm of oxidisable metal is relatively sensitive to oxidisable elements type and concentration, while toluene insolubles production for the range of about 1000 to about 2000 ppm and greater of oxidisable element concentration appears to be relatively constant.

Based on the results presented in the FIGURE, it is reasonable to conclude that the addition of an oxide particle precursor fluid to a combination containing relatively heavy hydrocarbon and a sulfide particle precursor fluid can serve to reduce the amount of toluene insolubles produced in the course of a hydrocracking reaction. Thus, the catalytic activity of 100 ppm of molybdenum as molybdenum sulfide particles in the presence of about 1000 ppm or more of an oxidisable element in oxide particle form is approximately twice as great for toluene-insolubles suppression as compared to that of molybdenum sulfide particles alone. Moreover, the advantages relating to of metal sulfide particles and oxide particles can be had without resort to solids handing operations.

It is significant that the selectivity functions illustrated in the FIGURE for each of the oxidisable elements tested appear to be asymptotic to a hydrocracking selectivity corresponding to about 2.5 weight percent of toluene-insolubles production under the above-described reaction conditions. These results indicate that, within limits, lesser amounts of toluene-insolubles are formed as the oxidisable element concentration in the charge is increased. The range of about 1 to about 5000 ppm, preferably of about 1 to about 2000 ppm, and more preferably of about 1 to about 1000 ppm by weight of oxidisable element concentration appears to be critical for suppressing toluene insoluble production, as further increases in oxidisable element concentration appear to have relatively less effect.

EXAMPLE 11, 12, and 13

In order to demonstrate the virtual absence of hydrogenation catalyst activity exhibited by a typical oxidisable element in a reaction zone under hydrogenation conditions but without metal sulfide particles, the following three procedures were performed. Firstly, as a control procedure, the catalyst performance testing procedure described above was performed, except that no metal sulfide precursor fluid and no oxide precursor fluid were added to the blended charge. The procedure produced 16.0 weight percent of toluene insolubles. This result is believed to be representative of toluene soluble production without the benefit of any artificially introduced catalyst.

Secondly, the catalyst performance testing procedure was also substantially repeated with no metal sulfide precursor fluid, but with an appropriate amount of aluminum carboxylate added to provide 1000 ppm by weight of aluminum in the blended charge. This procedure produced 13.5 weight percent toluene insolubles.

The catalyst performance testing procedure was again substantially repeated with no metal sulfide precursor fluid, but with an appropriate amount of titanium carboxylate added to provide 1000 ppm by weight of titanium in the blended charge. The metal sulfide-free procedure utilizing titanium produced 13.0 weight percent toluene insolubles.

Comparing the results of the three above-described catalyst performance testing procedures conducted with no sulfide particle precursor fluid, it is apparent that the presence of aluminum oxide particles or titanium oxide particles does not significantly affect toluene insoluble production. The slight disparity in the three results is believed to be within the limits of inherent reproducibility for the catalyst performance testing procedure at these relatively high toluene insoluble levels. Therefore, the three results indicate that oxide particles exhibit essentially no hydrogenation catalyst activity in a reaction zone which is under hydrogenation reaction conditions but does not contain a hydrogenation catalyst, such as metal sulfide particles.

Although Examples and hypotheses have been set forth above in order to better communicate the invention, they are not intended to limit the scope of the invention or the appended claims.

We claim as our invention:

1. A method for converting a hydrocarbonaceous feedstock to a product having a boiling point which is lower than the boiling point of the hydrocarbonaceous feedstock, which comprises:

blending a hydrocarbonaceous feedstock and an oxide particle precursor fluid;

heating the resulting blend to precipitate oxide particles;

suspending metal sulfide particles and the oxide particles as a dispersion in a reaction zone including hydrogen and the feedstock; the reaction zone being maintained under hydrogenation reaction conditions effective to convert the feedstock to a product having a boiling point which is lower than the boiling point of the hydrocarbonaceous feedstock; the metal sulfide particles having an effective suspended particle size of about 0.001 to about 50 microns and being composed essentially of a metal sulfide which persists under the reaction conditions and is a sulfide of a sulfidable transition metal or mixtures thereof; the oxide particles having an effective suspended particle size of about 0.001 to about 50 microns and being composed essentially of an oxide which persists under the reaction conditions and is an oxide of oxidisable element selected from Group IIA, IIIB, IVB, IIIA, IVA, or VA of the Periodic Table of the Elements or mixtures thereof;

separating the product from the metal sulfide particles and the oxide particles; and recovering the product.

2. The method of claim 1 wherein a sulfide particle precursor fluid, which upon heating precipitates to form the metal sulfide particles, is blended with the feedstock or injected into the reaction zone in order to introduce the metal sulfide particles into the reaction zone.

3. The method of claim 2 wherein at least one of the oxide particle precursor fluid and the sulfide particle precursor fluid is soluble in the feedstock and, before any heating effective to cause the feedstock soluble particle precursor fluid to precipitate, the blend is a hydrocarbonaceous solution including the feedstock soluble particle precursor fluid and the feedstock.

4. The method of claim 2 wherein at least one of the oxide particle precursor fluid and the sulfide particle precursor fluid is water soluble and, before any heating effective to cause the sulfide particle precursor fluid to precipitate, the water soluble particle precursor fluid is present in the blend as a solute in an aqueous solution which is emulsified with the feedstock.

5. The method of claim 1 wherein the metal sulfide is a sulfide of a sulfidable transition metal selected from the group consisting of molybdenum, cobalt, nickel, iron, vanadium, tungsten and mixtures thereof.

6. The method of claim 1 wherein the oxide is an oxide of an oxidisable element selected from the group consisting of magnesium, aluminum, silicon, phosphorous, calcium, scandium, titanium, gallium, germanium, zirconium, cerium, and mixtures thereof.

7. The method of claim 1 wherein the total weight of the oxidisable element in the oxide particles dispersed in the reaction zone is about 1 to about 5000 parts per million, based on the sum of weight of the feedstock and the weight of the lower boiling point product in the reaction zone.

8. The method of claim 1 wherein the total weight of the sulfidable metal in the metal sulfide particles in the reaction zone is about 1 to about 500 parts per million by weight, based on the sum of the weight of the feedstock and the weight of the lower boiling point product in the reaction zone.

9. The method of claim 1 wherein the feedstock includes at least about five volume percent of a hydrocarbon material having a weight average boiling point at atmospheric pressure equal to or greater than 1000° F.

10. The method of claim 1 wherein the effective reaction zone conditions include a temperature of about 750 to about 900° F. and a hydrogen partial pressure of about 1000 to about 3500 pounds per square inch absolute.

11. The method of claim 1 wherein the sulfidable metal is a hydrogenation catalyst and the oxide is not a hydrogenation catalyst, under the reaction conditions maintained in the reaction zone.

12. The method of claim 1 wherein the oxide particles exhibit essentially no catalytic activity for promoting hydrocarbon hydrogenation reactions in a reaction zone including hydrogen and a hydrocarbonaceous feedstock and not including any conventional hydrogenation catalyst, the reaction zone being maintained under hydrogenation reaction conditions effective to convert the feedstock to a product having a boiling point which is lower than the boiling point of the hydrocarbonaceous feedstock.

13. A method for converting a hydrocarbonaceous feedstock to a product having a boiling point which is lower than the boiling point of the hydrocarbonaceous feedstock, which comprises:

precipitating a sulfide particle precursor fluid which is present as a solute in a hydrocarbonaceous feedstock and includes a hydrocarbon soluble metal compound containing a sulfidable metal selected from the group consisting of molybdenum, cobalt, nickel, iron, vanadium, tungsten and mixtures thereof to produce metal sulfide particles composed essentially of a metal sulfide of the sulfidable metal;

precipitating an oxide particle precursor fluid which is present as a solute in the hydrocarbonaceous feedstock and includes a hydrocarbon soluble metal compound containing an oxidisable element selected from the group consisting of magnesium, aluminum, silicon, phosphorous, calcium, scandium, titanium, gallium, germanium, zirconium, cerium, and mixtures thereof to produce oxide particles composed essentially of an oxide of the oxidisable element;

suspending the metal sulfide particles and the oxide particles in a reaction zone which includes hydrogen, and the hydrocarbonaceous feedstock so as to create a dispersion under hydrogenation reaction conditions which are effective to convert the feedstock to a product having a boiling point which is lower than the boiling point of the hydrocarbonaceous feedstock;

separating the lower boiling point product from the metal sulfide particles and the oxide particles; and recovering the lower boiling point product.

14. The method of claim 13 wherein the total weight of the oxidisable element in the oxide particles dispersed in the reaction zone is about 1 to about 5000 parts per million, based on the sum of weight of the feedstock and the weight of the lower boiling point product in the reaction zone.

15. The method of claim 13 wherein the total weight of the sulfidable metal in the metal sulfide particles in the reaction zone is about 1 to about 500 parts per million by weight, based on the sum of the weight of the feedstock and the weight of the lower boiling point product in the reaction zone.

16. The method of claim 13 wherein the sulfide particle precursor fluid is composed essentially of a carboxylate, a pentanedioate, a carbamate, an alkoxide, an oxometallate, a phosphate, a thiocarboxylate, a dithiocarbamate, a thiolate or a thiometallate of a metal selected from the group consisting of molybdenum, cobalt, tungsten, iron, nickel, vanadium, and mixtures thereof.

17. The method of claim 13 wherein the oxide particle precursor fluid is selected from the group consisting of calcium sulfonate overbased with calcium carbonate, titanium carboxylate, aluminum carboxylate, cerium carboxylate, tributyl phosphate, and tetraethylorthosilicate.

* * * * *

UNITED STATES PATENT AND TRADEMARK OFFICE

CERTIFICATE OF CORRECTION

PATENT NO. : 5,954,945

DATED : Sep. 21, 1999

INVENTOR(S) : Roger H. Cayton, Ronald B. Fisher, Jeffrey T. Miller, John A. Waynick It is certified that error appears in the above-identified patent and that said Letters Patent is hereby corrected as shown below:

| Col. | Line | |
|---|---|---|
| 1 | 38 | "such as resids, refmers"<br><br>should read:<br>"such as resids, refiners" |
| 4 | 54 | "DESCRIPTION OF THE DRAWINGS"<br><br>should read:<br>"BRIEF DESCRIPTION OF THE DRAWINGS" |
| 9 | 65 | "of a oxide"<br><br>should read:<br>"of an oxide" |
| 10 | 55 | "about 1300 about"<br><br>should read:<br>"about 1300 to about" |

UNITED STATES PATENT AND TRADEMARK OFFICE

CERTIFICATE OF CORRECTION

PATENT NO. : 5,954,945

DATED : Sept. 21, 1999

INVENTOR(S) : Roger H. Cayton, et al

It is certified that error appears in the above-identified patent and that said Letters Patent is hereby corrected as shown below:

| Col. | Line | |
|---|---|---|
| 12 | 51,52 | "1000 ppm by of titanium"<br><br>should read:<br>"1000 ppm of titanium" |
| 13 | 22 | "relating to of metal"<br><br>should read:<br>"relating to metal" |
| 13 | 24 | "handing operations."<br><br>should read:<br>"handling operations." |

Signed and Sealed this

Eighth Day of August, 2000

*Attest:*

*Attesting Officer*

Q. TODD DICKINSON

*Director of Patents and Trademarks*